US010290421B2

(12) United States Patent
Liao

(10) Patent No.: US 10,290,421 B2
(45) Date of Patent: May 14, 2019

(54) MANUFACTURING METHOD OF AN ATTRACTION PLATE FOR ELECTROMAGNETIC DOOR LOCKS

(71) Applicant: Yi-Fan Liao, Taoyuan County (TW)

(72) Inventor: Yi-Fan Liao, Taoyuan County (TW)

( * ) Notice: Subject to any disclaimer, the term of this patent is extended or adjusted under 35 U.S.C. 154(b) by 356 days.

(21) Appl. No.: 15/151,660

(22) Filed: May 11, 2016

(65) Prior Publication Data

US 2016/0251884 A1 Sep. 1, 2016

Related U.S. Application Data

(63) Continuation-in-part of application No. 14/726,790, filed on Jun. 1, 2015, now abandoned, which is a continuation-in-part of application No. 14/161,846, filed on Jan. 23, 2014, now abandoned.

(51) Int. Cl.
*H01F 41/02* (2006.01)
*E05C 19/16* (2006.01)

(52) U.S. Cl.
CPC ..... *H01F 41/02* (2013.01); *E05C 19/166* (2013.01); *E05C 19/168* (2013.01); *H01F 41/0253* (2013.01); *Y10T 29/4902* (2015.01); *Y10T 29/49075* (2015.01)

(58) Field of Classification Search
CPC ..... E05C 19/166; E05C 19/168; H01F 41/02; H01F 41/0253; Y10T 29/4902; Y10T 29/49075
See application file for complete search history.

(56) References Cited

U.S. PATENT DOCUMENTS 4,957,316 A * 9/1990 Frolov ..... E05C 19/166 292/251.5
5,184,855 A * 2/1993 Waltz ..... E05C 19/168 292/251.5
2010/0218569 A1* 9/2010 Hunt ..... E05C 19/166 70/263

FOREIGN PATENT DOCUMENTS

JP 2009133159 A * 6/2009

* cited by examiner

*Primary Examiner* — A. Dexter Tugbang
(74) *Attorney, Agent, or Firm* — Rosenberg, Klein & Lee

(57) ABSTRACT

A manufacturing method of an attraction plate for electromagnetic door locks has an attraction plate positioned on a mounted body with a positioning hole at the center thereof. The attraction plate further has an arch portion at the center thereof which is reversely proportional to a thickness thereof and the thickness thereof is pre-determined for manufacturing a different height of the arch portion thereof for better effects. With an internal stress from the curved design, a tensile value of a door lock is increased for better operation of a door lock.

12 Claims, 13 Drawing Sheets

MANUFACTURING METHOD OF AN ATTRACTION PLATE FOR ELECTROMAGNETIC DOOR LOCKS

This patent application is a continuation-in-part of Ser. No. 14/726,790 filed on Jun. 1, 2015, currently pending.

BACKGROUND OF THE INVENTION

1. Field of the Invention

The invention relates to a manufacturing method of an attraction plate for electromagnetic door locks, particularly to one that manufactures an attraction plate with two convex-curve surfaces to form a curved internal stress for door locks.

2. Description of the Related Art

FIG. 1 is an armature for electromagnetic locks in U.S. Pat. No. 4,957,316 disclosed by Frolov. Frolov disclosed an electromagnetic lock having an electromagnet mounted to a door frame and having an armature 22 mounted to a door 10 for attraction to the electromagnet to lock the door 10. The armature 22 has a strike plate 29 and a back plate 30. The strike plate 29 further has a recess for engagement with an end of a bolt 25, and the back plate 30 is disposed between the strike plate 29 and the door 10 and is penetrated through by the bolt 25 to be mounted to the door 10. In addition, the armature 22 has a surface 39 at the reverse side of the side with the recess, and the center of the armature 22 is slightly bowed toward the surface 39 thereof within a range of 0.004-0.005 inches. Such structure allows the back plate 30 of the armature 22 to attach to the strike plate 29 in operation; however, the range of bowing between 0.004-0.005 inches does not apply to attraction plates with different thicknesses. According to experiments conducted by the inventor, when Frolov's invention is applied to attraction plates with different thickness, the results may not be satisfying. In other words, the thickness of attraction plates in electromagnetic locks has essential relation with bowing of armatures.

FIG. 2 is an improved attraction plate structure for electromagnetic door locks disclosed by the present inventor in U.S. Ser. No. 14/149,166 filed on Jan. 7, 2014, which has since issued as U.S. Pat. No. 9,341,007. It has an attraction plate 30 disposed on a mounted body 40 by a positioning assembly. The attraction plate 30 has a recessed portion 32 arranged on an attraction surface 31 at a central region thereof, and the recessed portion 32 further extends towards both ends 34 to form a concave-arc surface 33 on the attraction plate 30. The concave-arc surface 33 is arranged to be lower than a horizontal plane within a range of 0.06-0.26 mm to achieve strong tensile force for applications. This application has exactly an opposite structure to the present invention; nevertheless, it can also achieve a satisfying tensile value.

In fact, apart from different designs of the attraction plate, thickness of the attraction plate also has something to do with the tensile values in such structure. Without proper numbers of the thickness, the tensile values would not achieve the best numbers in operation. Therefore, thickness of the attraction plate shall be further disclosed in accordance with a height arranged at a center of the attraction plate to obtain stronger tensile values.

SUMMARY OF THE INVENTION

A primary object of the present invention is to provide a manufacturing method of an attraction plate for electromagnetic door locks that is able to increase a tensile value of a door lock by at least 10%, in order to achieve purposes of energy-saving and ensuring safety.

To achieve the object mentioned above, the present invention comprises steps as following: a) providing an electric magnet in a long shape; b) providing a mounted body disposed at a corresponding side to the electric magnet with a positioning hole arranged in the middle thereof; c) providing an attraction plate with a thickness between 10-16 mm and a length in correspondence to the length of the electric magnet, said attraction plate including an attraction surface at a side facing the electric magnet; d) deciding a thickness of the attraction plate to determine a height of an arch portion arranged at the center on the attraction surface, the thickness of the attraction plate being inversely proportional to the height of the arch portion and the height being between 0.04-0.27 mm with the thickness of the attraction plate being between 10-16 mm; e) manufacturing the attraction plate according to pre-determined numbers of thickness and height in step d, the attraction plate having two corresponding convex-curve surfaces extending from the arch portion to both ends of the attraction plate, defining the arch portion a higher central region than both ends of the attraction plate; f) providing the attraction plate manufactured in steps c-e, which has an engaging hole correspondingly arranged to the positioning hole; and g) providing a bolt to fixedly screw the engaging hole to the positioning hole for placement of the attraction plate on the mounted body with the attraction surface thereof facing upward, defining both ends thereof as free ends. Among the steps, c)-f) are processed in advance.

With structures disclosed above, the present invention has the arch design to increase a tensile value of the electric magnet for door locks instead of the conventional method of increasing electric currents or attraction area of an attraction plate and an electric magnet. Such design also has features of energy-saving and efficient functioning for better safety.

DETAILED DESCRIPTION OF THE PREFERRED EMBODIMENT

Figure 1:
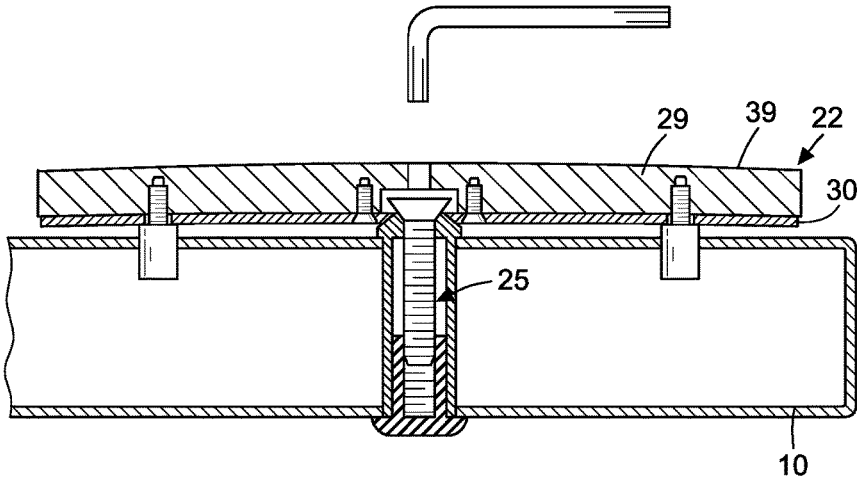
FIG.1 PRIOR ART
FIG. 1 is a schematic diagram of a mounted body of a conventional electromagnetic door lock.
Figure 2:
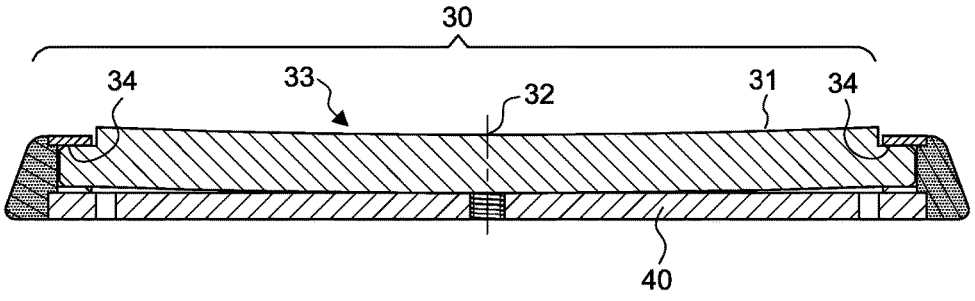
FIG.2 PRIOR ART
FIG. 2 is another schematic diagram of a mounted body of a conventional electromagnetic door lock.
Figure 3:
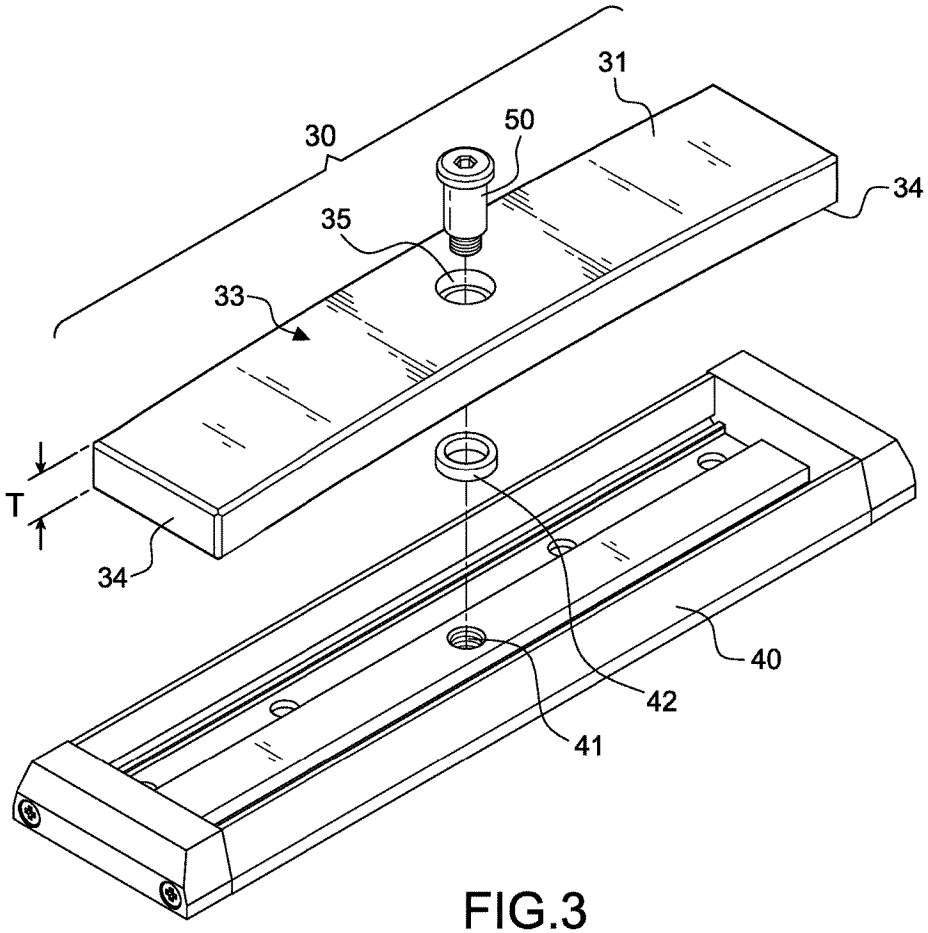
FIG. 3 is an exploded view of the present invention in a preferred embodiment.
Figure 4:
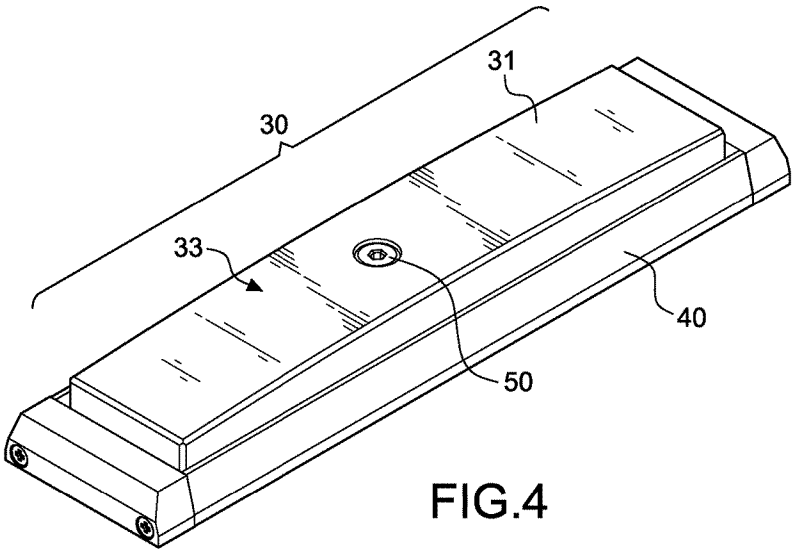
FIG. 4 is a perspective view of the present invention in a preferred embodiment.
Figure 5:
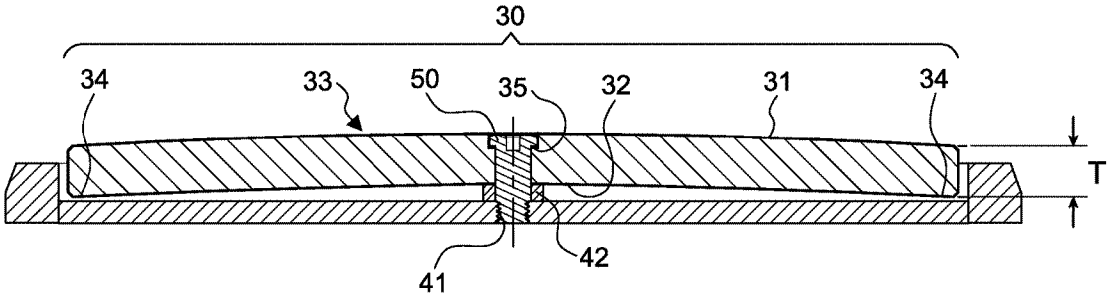
FIG. 5 is a sectional view of the present invention in a preferred embodiment.

Referring to FIGS. 3-9, in a preferred embodiment, the present invention comprises the following steps.

Step a: providing an electric magnet 20 in a long shape to be fixed to a door frame 15.

Step b: providing a mounted body 40 disposed at a corresponding side to the electric magnet 20 with a positioning hole 41 arranged in the middle thereof. The mounted body 40 can be in different design to be installed on a door plate 14. In this embodiment, it can be a box-shaped body, a U-shaped body, a L-shaped body, a flat body; or it can be made in one piece together with the door plate 14 for attraction engagement.

Step c: providing an attraction plate 30 with a thickness T between 10-16 mm and a length in correspondence to the length of the electric magnet 20. The attraction plate 30 also has an attraction surface 31 at a side facing the electric magnet 20.

Step d: deciding a thickness T of the attraction plate 30 to determine a height h of an arch portion 32 arranged at the center on the attraction surface 31. The thickness T of the attraction plate 30 is inversely proportional to the height h of the arch portion 32. With the thickness T of the attraction plate 30 being between 10-16 mm, the height h is arranged between 0.04-0.27 mm.

Figure 7A:
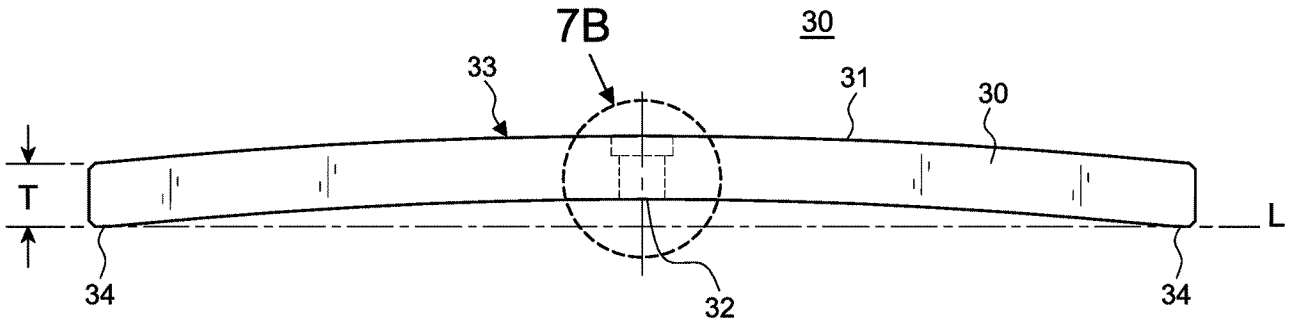
FIG. 7A is a sectional view of an attraction plate structure in the present invention.
Figure 7B:
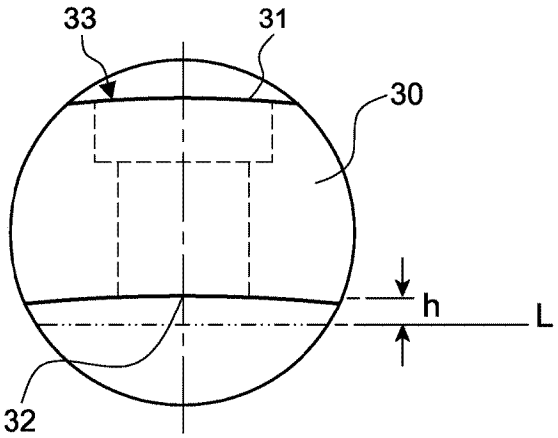
FIG. 7B is a partially enlarged view of area 7B in FIG. 7A.
Figure 8A:
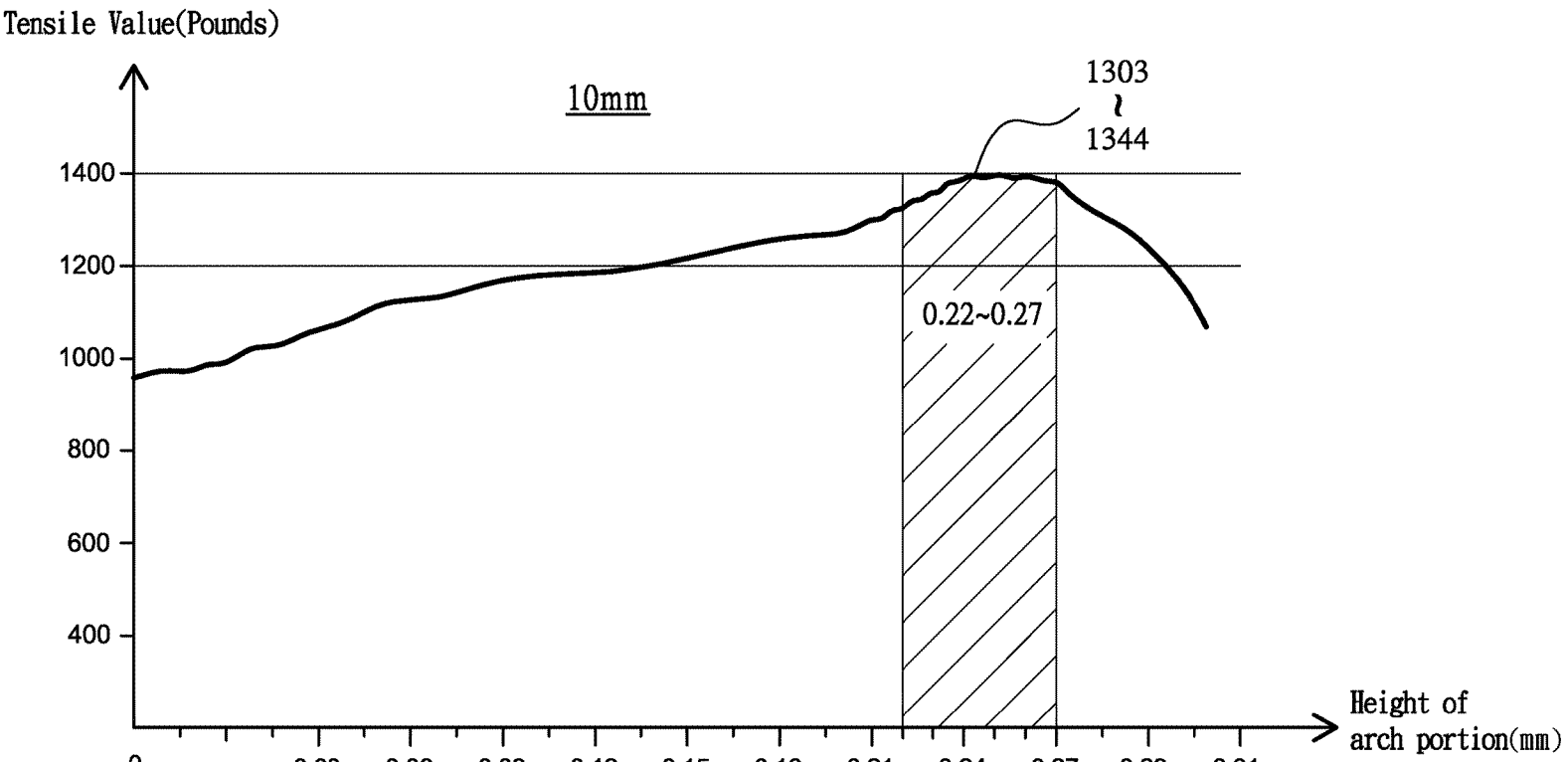
FIG. 8A is a spline chart illustrating a relationship between a height of the arch portion thereof and a thickness of the attraction plate with the attraction plate being 10 mm.
Figure 8B:
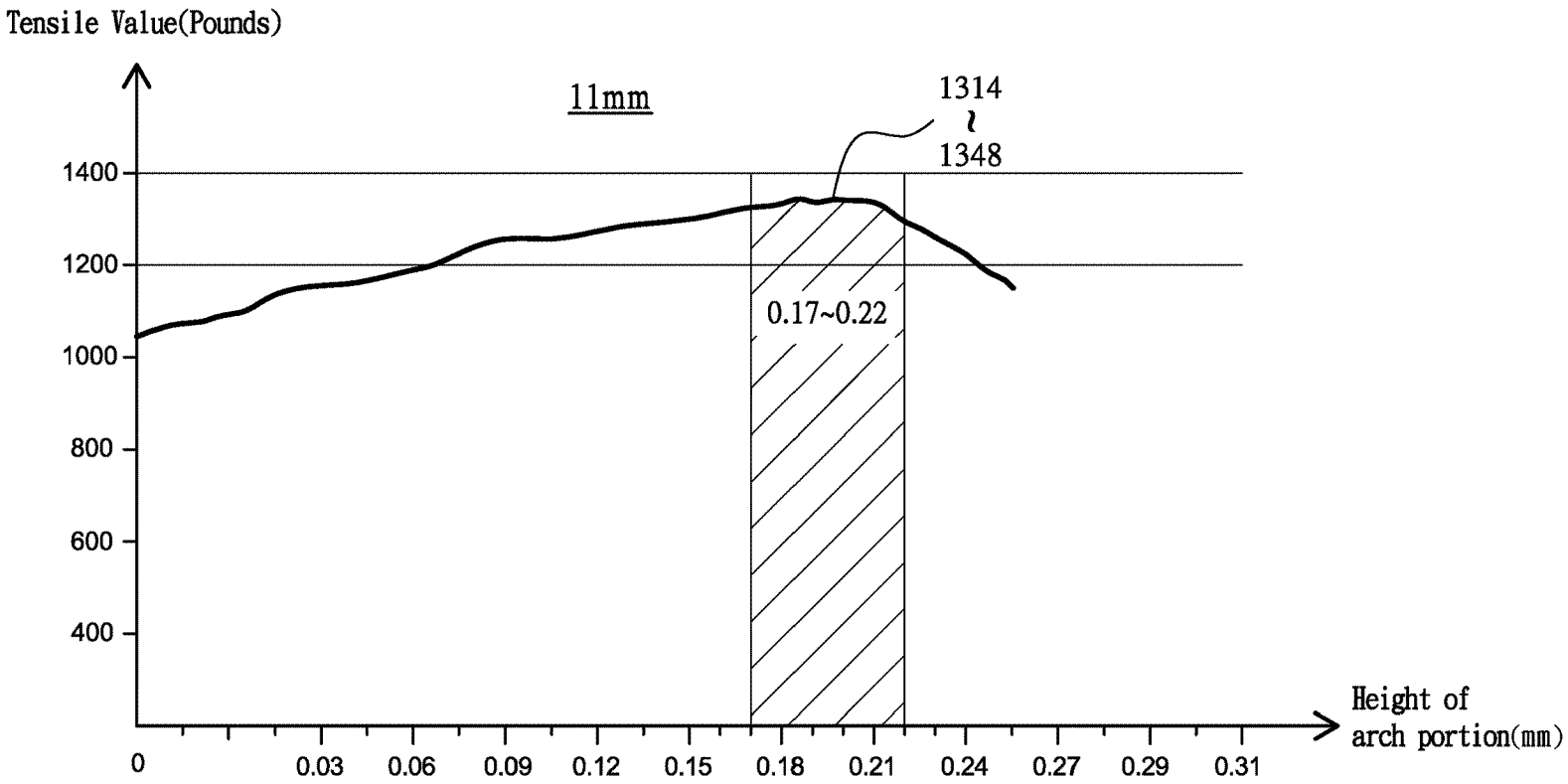
FIG. 8B is a spline chart illustrating a relationship between a height of the arch portion thereof and a thickness of the attraction plate with the attraction plate being 11 mm.
Figure 8C:
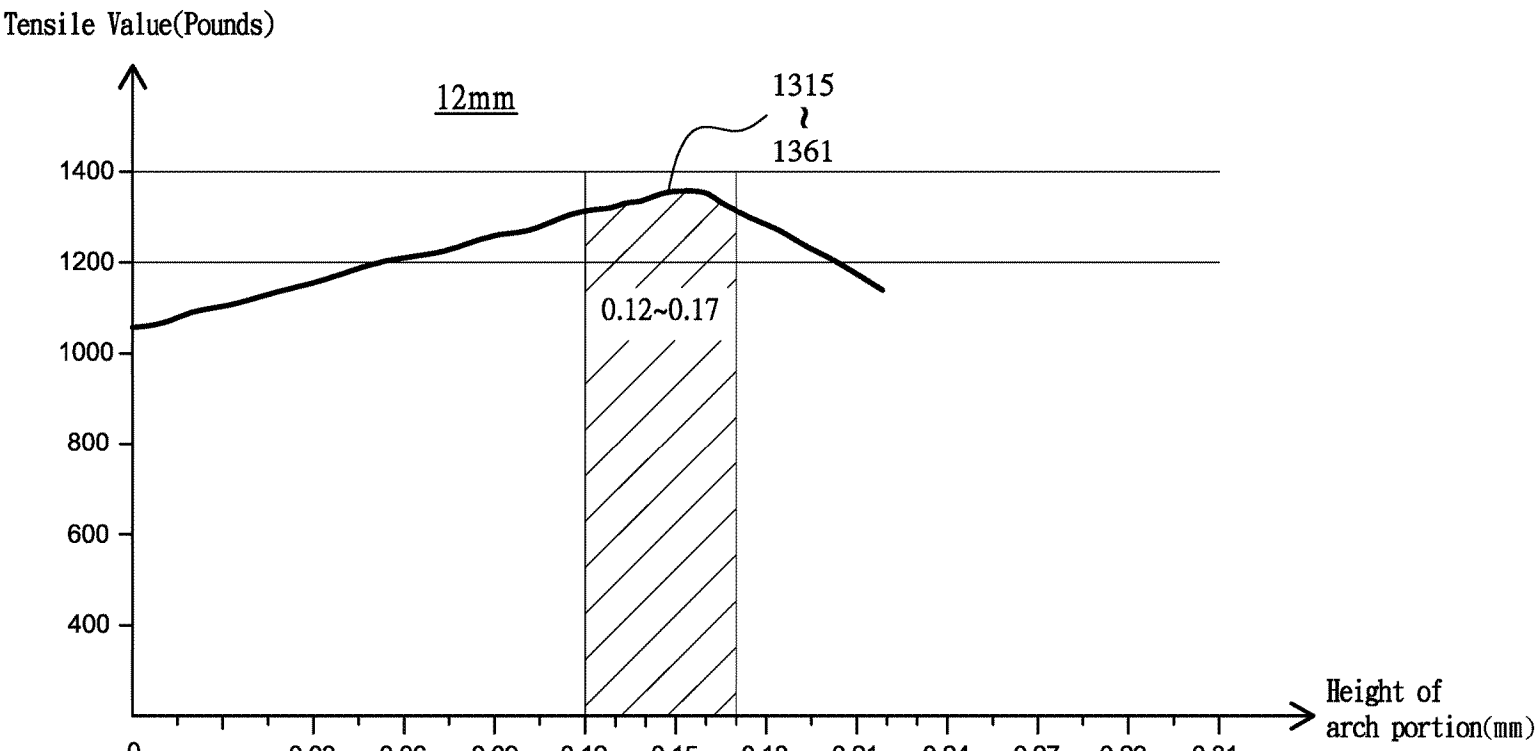
FIG. 8C is a spline chart illustrating a relationship between a height of the arch portion thereof and a thickness of the attraction plate with the attraction plate being 12 mm.
Figure 8D:
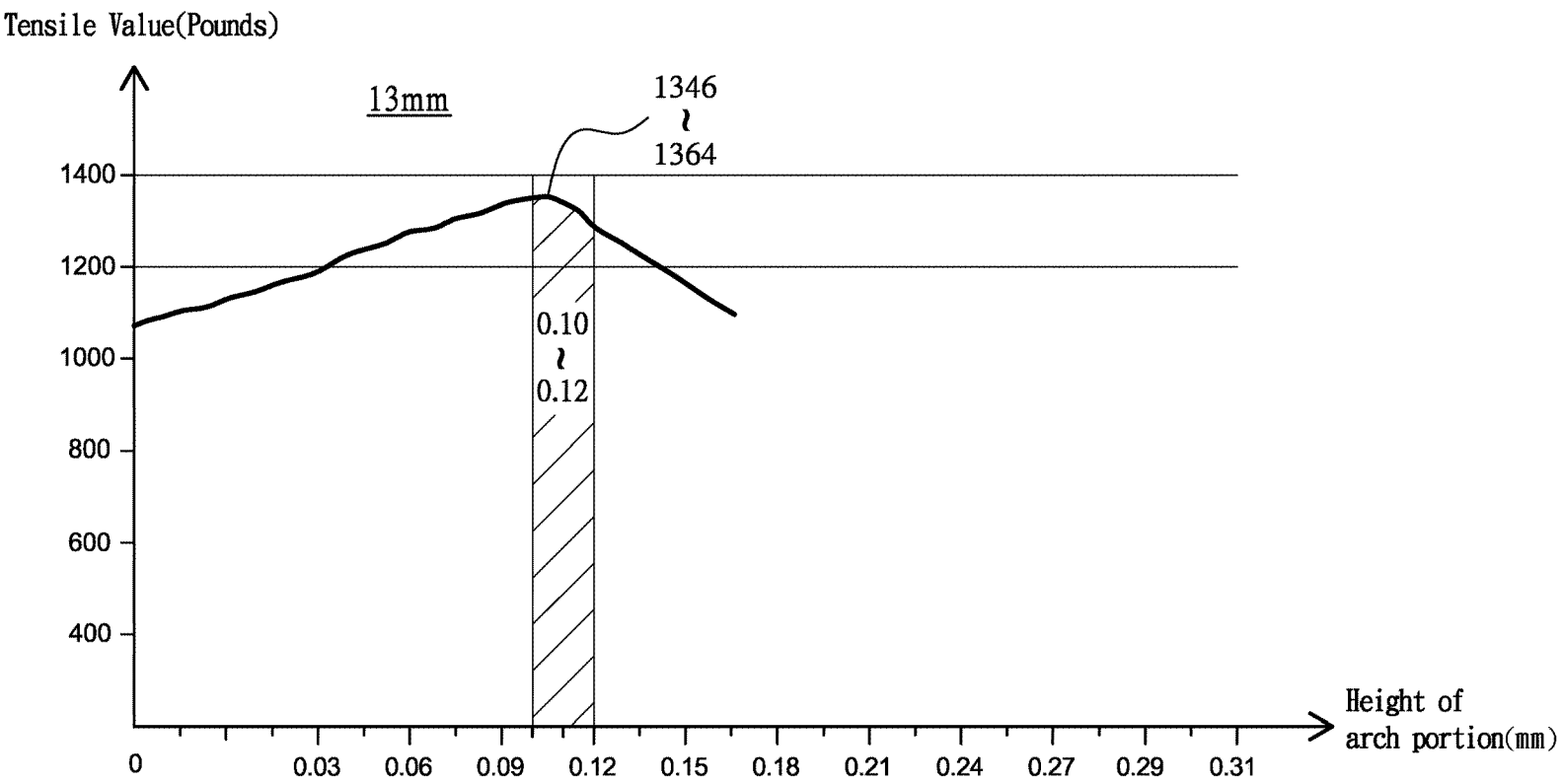
FIG. 8D is a spline chart illustrating a relationship between a height of the arch portion thereof and a thickness of the attraction plate with the attraction plate being 13 mm.
Figure 8E:
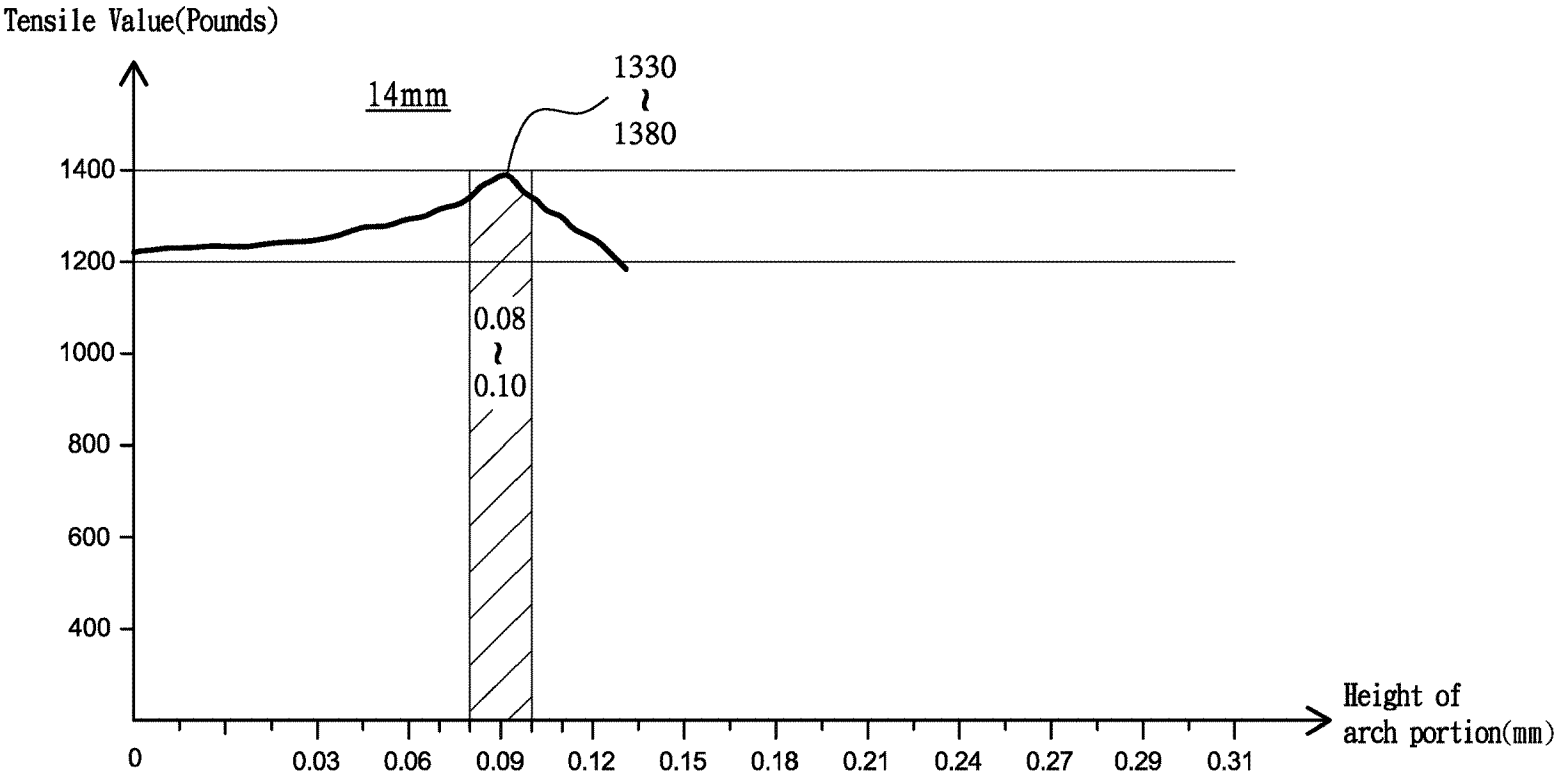
FIG. 8E is a spline chart illustrating a relationship between a height of the arch portion thereof and a thickness of the attraction plate with the attraction plate being 14 mm.
Figure 8F:
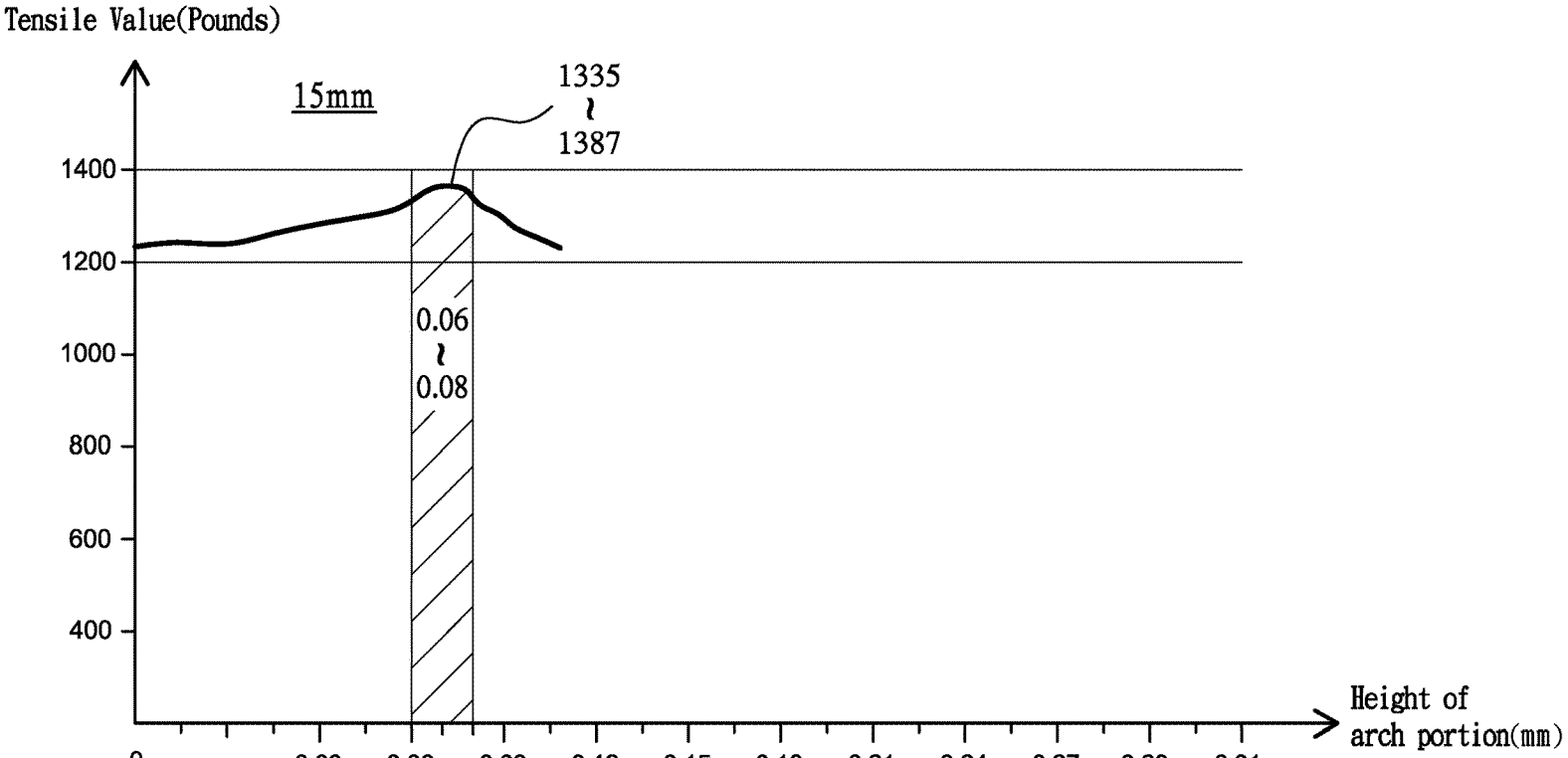
FIG. 8F is a spline chart illustrating a relationship between a height of the arch portion thereof and a thickness of the attraction plate with the attraction plate being 15 mm.
Figure 8G:
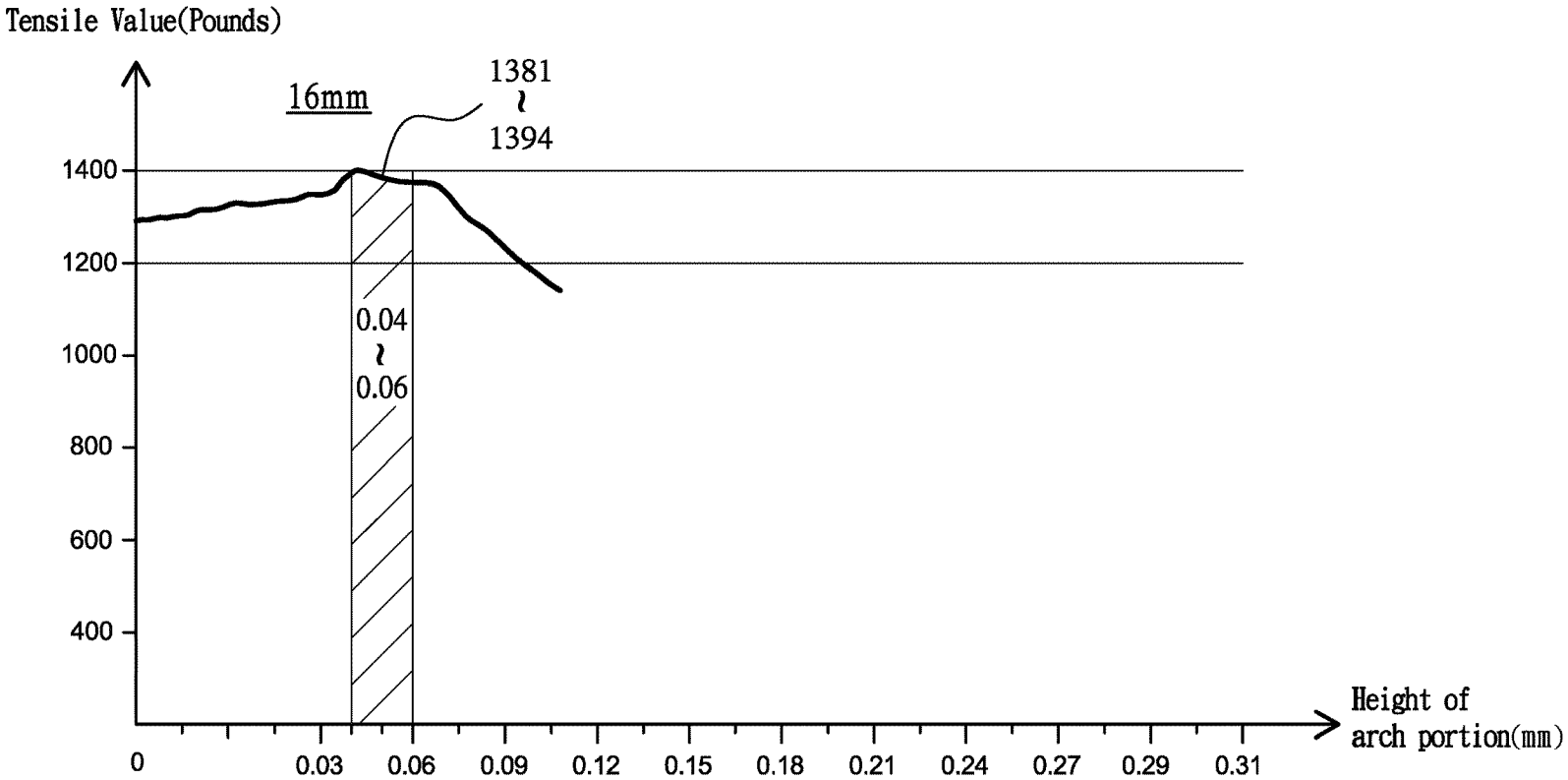
FIG. 8G is a spline chart illustrating a relationship between a height of the arch portion thereof and a thickness of the attraction plate with the attraction plate being 16 mm.

Step e: manufacturing the attraction plate 30 according to pre-determined numbers of thickness T and height h in step d. The attraction plate 30 further has two corresponding convex-curve surfaces 33 extending from the arch portion 32 to both ends 34, defining the arch portion 32 a higher central region than both ends 34. With reference to FIGS. 7A and 7B, the convex-curve surfaces 33 are higher than a bottom plane L. The bottom plane L is a virtual plane formed along the lowest point of the ends 34, and the height h of the arch portion 32 is the height from the lower bottom from the center of the arch portion 32 to the bottom plane L. With the inversely proportional relationship, the thinner the attraction plate 30 is within the 10-16 mm, the curve of the convex-curve surfaces 33 has a higher convex. The convex-curve surfaces 33 can be made by bending, stamping, shaping, or all known manufacturing method.

Step f: providing the attraction plate 30 manufactured in steps c-e with an engaging hole 35 arranged thereon correspondingly to the positioning hole 41 and a pad 42 arranged between the attraction plate 30 and the mounted body 40.

Step g: providing a bolt 50 to fixedly screw the engaging hole 35 to the positioning hole 41 for placement of the attraction plate 30 on the mounted body 40 with the attraction surface 31 thereof facing upward, defining both ends 34 thereof as free ends. In this embodiment, the pad 42 is the fulcrum for both ends 34 of the attraction plate 30 being free ends on the mounted body 40.

Figure 6:
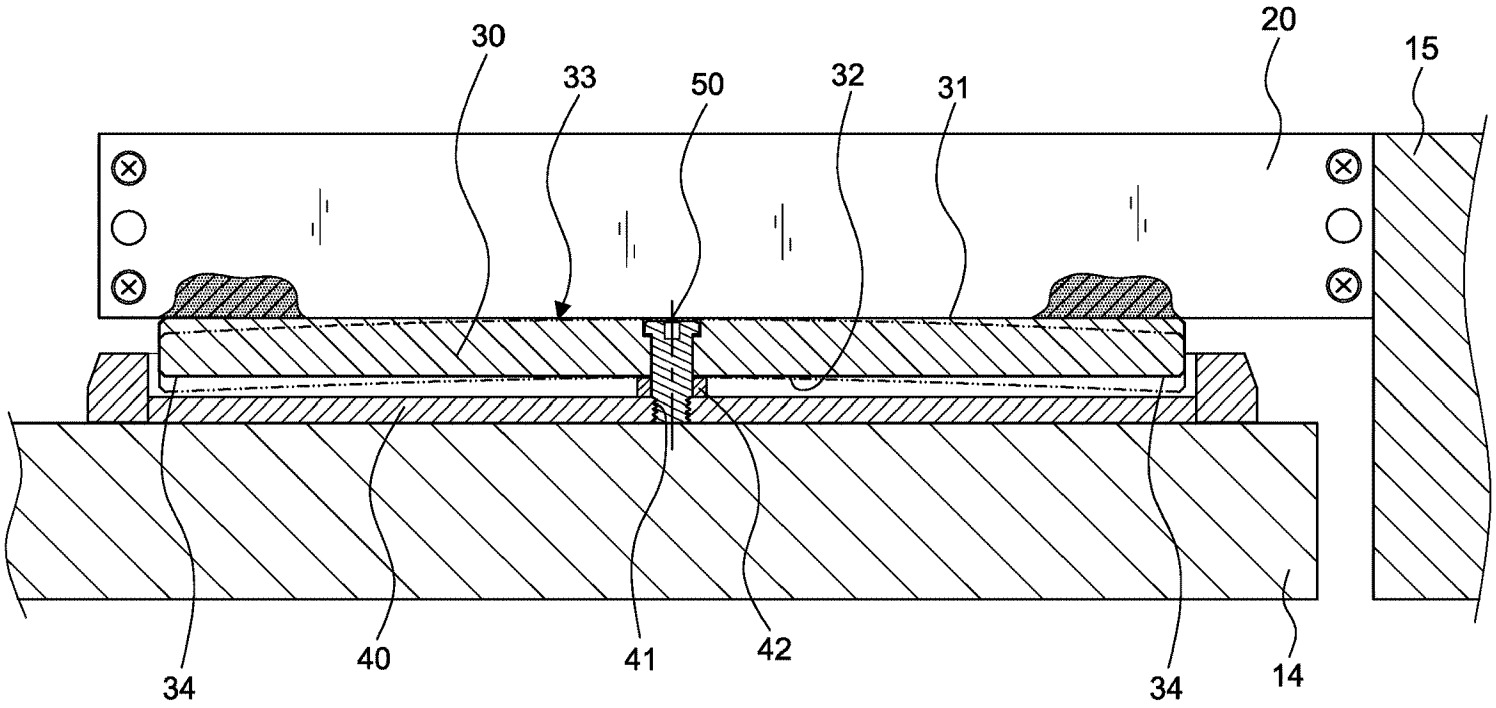
FIG. 6 is a sectional view of the present invention in a preferred embodiment illustrating a magnet thereof in attraction with an attraction plate thereof.

Thereby when the attraction plate 30 contacts the electric magnet 20, the attraction plate 30 with internal stress would be attracted, deformed and attached to the electric magnet 20 as shown in FIG. 6. Additionally, the steps c)-f) are processed in advance.

To further illustrate the essential relationship between the thickness T of the attraction plate 30 and the height h of the arch portion 32 thereof for better tensile values, an experiment is conducted and concluded in a table below. In the table, the thickness T has a length of 185 mm, a width of 60 mm and different thickness T of 10 mm, 11 mm, 12 mm, 13 mm, 14 mm, 15 mm, and 16 mm. The voltage is 12V and the electric magnet 20 has a 500 mA electric current passing through.

Tensile values with different thickness (T) and height (h)

| | Thickness (T) | | | | | | |
|---|---|---|---|---|---|---|---|
| Height (h) | 10 mm | 11 mm | 12 mm | 13 mm | 14 mm | 15 mm | 16 mm |
| 0.00 | 976 | 1060 | 1080 | 1190 | 1213 | 1245 | 1249 |
| 0.01 | 980 | 1085 | 1142 | 1252 | 1235 | 1240 | 1258 |
| 0.02 | 1000 | 1102 | 1150 | 1252 | 1245 | 1248 | 1284 |
| 0.03 | 1010 | 1113 | 1169 | 1257 | 1252 | 1256 | 1325 |
| 0.04 | 1044 | 1143 | 1201 | 1268 | 1274 | 1278 | 1394 |
| 0.05 | 1060 | 1158 | 1216 | 1280 | 1290 | 1301 | 1392 |
| 0.06 | 1065 | 1181 | 1222 | 1287 | 1304 | 1387 | 1381 |
| 0.07 | 1103 | 1188 | 1239 | 1298 | 1320 | 1385 | 1252 |
| 0.08 | 1117 | 1216 | 1269 | 1302 | 1376 | 1335 | 1248 |
| 0.09 | 1138 | 1226 | 1273 | 1310 | 1380 | 1215 | 1236 |
| 0.10 | 1150 | 1227 | 1280 | 1359 | 1330 | 1145 | 1115 |
| 0.11 | 1168 | 1250 | 1294 | 1364 | 1217 | 1110 | 1041 |
| 0.12 | 1184 | 1262 | 1315 | 1346 | 1187 | 1026 | 961 |
| 0.13 | 1197 | 1281 | 1330 | 1212 | 1145 | 943 | |
| 0.14 | 1212 | 1290 | 1337 | 1152 | 1064 | | |
| 0.15 | 1216 | 1298 | 1347 | 1105 | 937 | | |
| 0.16 | 1233 | 1299 | 1358 | 1035 | | | |
| 0.17 | 1263 | 1314 | 1361 | 953 | | | |
| 0.18 | 1276 | 1325 | 1298 | 938 | | | |
| 0.19 | 1279 | 1343 | 1275 | | | | |
| 0.20 | 1281 | 1345 | 1270 | | | | |
| 0.21 | 1285 | 1348 | 1241 | | | | |
| 0.22 | 1303 | 1313 | | | | | |
| 0.23 | 1318 | 1265 | | | | | |
| 0.24 | 1319 | 1116 | | | | | |
| 0.25 | 1324 | 964 | | | | | |
| 0.26 | 1344 | | | | | | |
| 0.27 | 1323 | | | | | | |
| 0.28 | 1270 | | | | | | |
| 0.29 | 1070 | | | | | | |
| 0.30 | 916 | | | | | | |

The values in the table are average numbers divided by 3 experiments for each combination of thickness T and height h. From the numbers we can learn that the tensile values have different results with different thickness T and height h. However, it can be further concluded as following with reference to FIGS. 8A to 8G.

The arch portion 32 has a height h between 0.22-0.27 mm when the attraction plate 30 has a thickness T of 10 mm to obtain a preferable range of strong tensile values.

The arch portion 32 has a height h between 0.17-0.22 mm when the attraction plate 30 has a thickness T of 11 mm to obtain a preferable range of strong tensile values.

The arch portion 32 has a height h between 0.12-0.17 mm when the attraction plate 30 has a thickness T of 12 mm to obtain a preferable range of strong tensile values.

The arch portion 32 has a height h between 0.10-0.12 mm when the attraction plate 30 has a thickness T of 13 mm to obtain a preferable range of strong tensile values.

The arch portion 32 has a height h between 0.08-0.10 mm when the attraction plate 30 has a thickness T of 14 mm to obtain a preferable range of strong tensile values.

The arch portion 32 has a height h between 0.06-0.08 mm when the attraction plate 30 has a thickness T of 15 mm to obtain a preferable range of strong tensile values.

The arch portion 32 has a height h between 0.04-0.06 mm when the attraction plate 30 has a thickness T of 16 mm to obtain a preferable range of strong tensile values.

Figure 9:
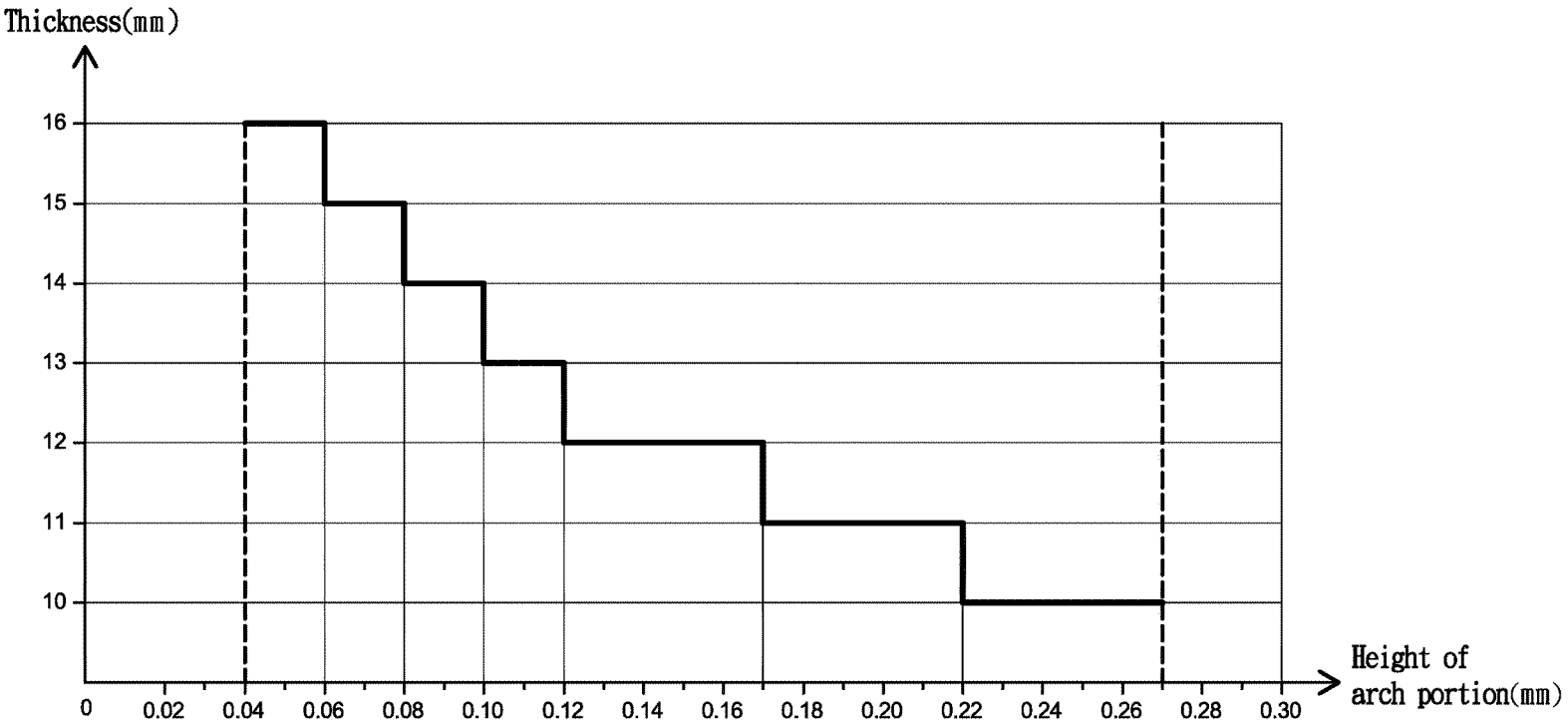
FIG. 9 is a chart concluding a preferable range of a height of the arch portion thereof with a thickness of the attraction plate ranging from 10 mm to 16 mm in accordance with the present invention.

Although numbers of the tensile values would be different due to different sizes of the attraction plate 30, the increase percentages and curves of spline charts would still remain in the same tendency since attraction plates in the markets usually have a length ranging from 180 mm to 200 mm. FIG. 9 is a further conclusion from FIGS. 8A to 8G illustrating the preferable ranges of heights h of the arch portion 32 with the thickness T of the attraction plate 30 ranging from 10-16 mm.

In conclusion, the present invention has the attraction plate 30 being able to increase at least 10% of tensile values with the same number of electric currents passing through the electric magnet 20 by the specific numbers obtained from experiments, so as to be applied to door locks with better safety and energy-saving features.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A manufacturing method of an attraction plate for electromagnetic door locks, comprising:

a) providing an electric magnet in a long shape;

b) providing a mounted body disposed at a corresponding side to the electric magnet with a positioning hole arranged in the middle of the mounted body;

c) selecting a thickness and a length for an attraction plate, the length for the attraction plate corresponding to a length of the electric magnet, said attraction plate including an attraction surface side for facing the electric magnet;

d) determining a height of an arch portion arranged at a center of the attraction surface, the height of the arch portion being determined based on, and inversely proportional to, the thickness of the attraction plate; and e) manufacturing the attraction plate according to the selected thickness and the determined height, the attraction plate having two corresponding convex-curve surfaces extending from the arch portion to both ends of the attraction plate, a peak of the arch portion raised from both of the ends of the attraction plate in a direction faced by the attraction surface by the determined height;

f) providing the manufactured attraction plate with an engaging hole correspondingly arranged to the positioning hole; and g) providing a bolt to fixedly screw the engaging hole to the positioning hole for placement of the attraction plate on the mounted body with the attraction surface of the attraction plate facing upward, defining both of the ends of the attraction plate as free ends.

2. The method as claimed in claim 1, wherein the thickness (T) of the attraction plate is 10 mm≤T≤16 mm, and the height (h) of the arch portion is 0.04 mm≤h≤0.27 mm.

3. The method as claimed in claim 2, wherein the thickness of the attraction plate is substantially 10 mm and the height of the arch portion is 0.22 mm≤h≤0.27 mm.

4. The method as claimed in claim 2, wherein the thickness of the attraction plate is substantially 11 mm and the height of the arch portion is 0.17 mm≤h≤0.22 mm.

5. The method as claimed in claim 2, wherein the thickness of the attraction plate is substantially 12 mm and the height of the arch portion is 0.12 mm≤h≤0.17 mm.

6. The method as claimed in claim 2, wherein the thickness of the attraction plate is substantially 13 mm and the height of the arch portion is 0.10 mm≤h≤0.12 mm.

7. The method as claimed in claim 2, wherein the thickness of the attraction plate is substantially 14 mm and the height of the arch portion is 0.08 mm≤h≤0.10 mm.

8. The method as claimed in claim 2, wherein the thickness of the attraction plate is substantially 15 mm and the height of the arch portion is 0.06 mm≤h≤0.08 mm.

9. The method as claimed in claim 2, wherein the thickness of the attraction plate is substantially 16 mm and the height of the arch portion is 0.04 mm≤h≤0.06 mm.

10. The method as claimed in claim 1, wherein the mounted body is a box-shaped body, a U-shaped body, a L-shaped body, a flat body, or a door plate.

11. The method as claimed in claim 1, wherein the mounted body further has a pad disposed between the attraction plate and the mounted body.

12. The method as claimed in claim 1, wherein the engaging hole is a spot-faced hole.

* * * * *